US006782367B2

(12) United States Patent
Vainio et al.

(10) Patent No.: US 6,782,367 B2
(45) Date of Patent: Aug. 24, 2004

(54) METHOD AND ARRANGEMENT FOR CHANGING SOURCE SIGNAL BANDWIDTH IN A TELECOMMUNICATION CONNECTION WITH MULTIPLE BANDWIDTH CAPABILITY

(75) Inventors: Janne Vainio, Lempäälä (FI); Hannu Mikkola, Tampere (FI); Jani Rotola-Pukkila, Tampere (FI)

(73) Assignee: Nokia Mobile Phones Ltd., Espoo (FI)

( * ) Notice: Subject to any disclaimer, the term of this patent is extended or adjusted under 35 U.S.C. 154(b) by 695 days.

(21) Appl. No.: 09/850,889

(22) Filed: May 8, 2001

(65) Prior Publication Data

US 2001/0044712 A1 Nov. 22, 2001

(30) Foreign Application Priority Data

May 8, 2000 (FI) ..... 20001070

(51) Int. Cl.[7] ..... G10L 21/04

(52) U.S. Cl. ..... 704/500; 704/201; 704/504; 704/503

(58) Field of Search ..... 704/223, 258, 704/264, 217, 206, 278, 500, 501, 503, 504

(56) References Cited

U.S. PATENT DOCUMENTS 5,414,796 A 5/1995 Jacobs et al. ..... 395/2.3
6,496,794 B1 * 12/2002 Kleider et al. ..... 704/201

FOREIGN PATENT DOCUMENTS

WO WO 97/15983 5/1997
WO WO 02/060075 8/2002

OTHER PUBLICATIONS

ITU–T Recommendation G.722.
Technical Specification GSM 04.53, V1.6.0.
Recommendation GSM 06.10.
"Capacity and Speech Quality Aspects Using Adaptive Multi–Rate (AMR)," Corbun et al, 1998 IEEE, pp. 1535–1539.
"An Adaptive Multi–Rate Speech Codec Based on MP–CELP Coding Algorithm for ETSI AMR Standard", Hironori et al., 1998 IEEE, pp. 137–140.
"The Adaptive Multi–Rate Speech Coder", Ekudden et al., 1999 IEEE, pp. 117–119.

* cited by examiner

*Primary Examiner*—Doris H. To
*Assistant Examiner*—Huyen X Vo
(74) *Attorney, Agent, or Firm*—Perman & Green LLP

(57) ABSTRACT

A speech encoding or decoding arrangement (711, 721, 811, 821) comprises a speech signal input and a multiple mode speech encoder (402) or decoder (411) for encoding or decoding speech signals coupled to the speech signal input selectably with a first encoding or decoding mode associated with a first bandwidth or a second encoding or decoding mode associated with a second bandwidth. It comprises a soft bandwidth switching block (401, 412, 500) with an input (IN) and an output (OUT). In an encoding arrangement the input (IN) is coupled to the speech signal input and the output (OUT) is coupled to the multiple mode speech encoder (402). In a decoding arrangement the input (IN) is coupled to the multiple mode speech decoder (411) and the output (OUT) is the output of the decoding arrangement. The soft bandwidth switching block (401, 412, 500) is arranged to gradually change the bandwidth of a speech signal coupled to the multiple mode speech encoder or decoder as a response to an instruction for changing speech signal bandwidth (421).

33 Claims, 7 Drawing Sheets

METHOD AND ARRANGEMENT FOR CHANGING SOURCE SIGNAL BANDWIDTH IN A TELECOMMUNICATION CONNECTION WITH MULTIPLE BANDWIDTH CAPABILITY

TECHNOLOGICAL FIELD

The invention concerns generally the field of encoding and decoding a signal to be transmitted over a telecommunication connection. Especially the invention concerns the procedures of changing the signal bandwidth of such a signal during the course of the telecommunication connection.

BACKGROUND OF THE INVENTION

FIG. 1 illustrates the general principle of transmitting speech from a first terminal to a second terminal in a digital cellular radio network. In the first terminal 100 there is a series connection of a microphone 101, a speech encoder 102, a channel encoder 103, a modulator 104 and a radio transmitter 105. In a first base station 110 there is a series connection of a radio receiver 111, a demodulator 112, a channel decoder 113 and a line transmitter 114. From the first base station 110 to a second base station 120 there is a network connection 115. The second base station 110 comprises a series connection of a line receiver 121, a channel encoder 122, a modulator 123 and a radio transmitter 124. In a second terminal 130 there is a series connection of a radio receiver 131, a demodulator 132, a channel decoder 133, a speech decoder 134 and a loudspeaker 135.

The speech encoder 102 in the transmitting terminal 100 converts the analogue speech signal that comes from the microphone 101 into a digital signal by applying a certain speech encoding scheme. The channel encoder 103 adds redundancy to the digital signal in order to enhance its robustness against corrupting effects at the radio interface. The channel decoder 113 removes at least partly the channel decoding, because wired connections through the network 115 are much more reliable than radio connections and excessive channel coding would only consume transmission capacity in the network. A corresponding pair of channel encoding 122 and channel decoding 133 exists around the second radio interface. The speech decoder 134 reconverts the digital speech signal into analog by applying a procedure that is an inverse of the above-mentioned speech encoding scheme. The principles described above are easily generalized to the transmission of arbitrary information between terminals by replacing the microphone 101 with a generic data source, the speech encoder 102 with a source encoder, the speech decoder 134 with a corresponding decoder and the loudspeaker 135 with a generic data sink.

An encoding and decoding unit is usually referred to as a codec. The specifications of conventional digital cellular radio systems like the original GSM (Global System for Mobile telecommunications) typically define speech (or source) codecs that have a constant output bit-rate and that handle a speech (or source) signal the bandwidth of which is constant. Depending on the bandwidth the conventional speech codecs have been designated as either narrowband or wideband codecs. For example the so-called RPE-LTP full-rate speech codec described in the GSM standard number GSM 06.10 is a narrowband speech codec the bandwidth of which is approximately 3.5 kHz. Its bit-rate in speech coding is 13 kbit/s and in channel coding 9.8 kbit/s which together makes 22.8 kbit/s. Exemplary wideband speech codecs are those standardized by the ITU (International Telecommunication Union) under the designations G.722-64, G.722-56 and G.722-48. Their speech coding bit-rates are 64, 56 and 48 kbit/s respectively, and their bandwidth is approximately 7 kHz.

Recent proposals for enhancements to the known arrangements in speech (or source) coding include the concept of AMR or Adaptive MultiRate coding. The idea is to keep the bit (or symbol) rate at the output of the channel encoder 103 constant but to allow the roles of the speech encoder 102 and the channel encoder 103 to change in generating the constant bit-rate. The input bandwidth of the speech encoder is constant (in GSM AMR, the same 3.5 kHz as in the basic GSM speech codec mentioned above), but if the speech encoder is allowed to use more bits per time unit, better audible quality can be achieved. Using a larger portion of the available bit-rate for speech coding is only possible on condition that the corruptive effects of noise and interference of the moment are not too bad. At the receiving end the AMR concept means that the bit (or symbol) rate at the input of the channel decoder 133 is constant, but the amount of redundancy removed in the channel decoder and correspondingly the amount of digital information per time unit available for reconstructing the original analog speech signal in the speech decoder 134 may vary.

At the priority date of the present patent application the known AMR speech coding principle is going to be adopted in standardizing a wideband or 7 kHz speech codec for future use within the GSM frameworks. It is possible that in the near future there will be communication devices in use which have two selectable speech (or source) bandwidths: 3.5 kHz and 7 kHz. It is also possible that even more speech (or source) bandwidths will be defined. The bandwidths can be associated with the use of completely different codecs or they may represent just certain modes of operation, known as the codec modes or just modes, of the speech encoding and decoding arrangements. The application of the AMR principle means that a future speech (or source) codec may have both a selectable bandwidth and a changing bit-rate, where the latter is associated with different levels of error protection through different distributions of the available gross bit-rate between speech (or source) coding and channel coding.

FIG. 2 illustrates in more detail the contents of the speech encoder block 102 in a transmitting mobile station and the speech decoder block 134 in a receiving mobile station in a known exemplary case where two different speech bandwidths have been defined. Here the concepts of encoding and decoding are understood in a wide sense so that e.g. A/D and D/A conversions are parts thereof. The A/D converter 201 in the encoder 102 is coupled to a switching block 202 both directly and through a downsampling block 203. The output of the switching block 203 is coupled to a speech encoder proper 204 which is capable of handling both a wideband and a narrowband input signal. The communication channel 210 between the output of the speech encoder proper 204 and the input of a corresponding speech decoder proper 220 in the speech decoder block 134 comprises generally e.g. all channel encoding/decoding and transmitting/receiving arrangements. The speech decoder proper 220 is capable of decoding both wideband and narrowband speech signals, and the output thereof is coupled to a switching block 221 both directly and through an upsampling block 222. The output of the switching block 221 is coupled to a speech synthesizer and D/A converter 223.

The A/D converter 201 in the encoder block 102 and the D/A converter 223 in the decoder block 134 both handle a sampling rate that is high enough for the widest defined speech bandwidth. The downsampling block 203 reduces the sampling rate of the sample stream produced by the A/D converter 201 to a lower level by puncturing, filtering or interpolating, and the upsampling block 222 inflates the sampling rate of the sample stream produced by the speech decoder proper 220 to a higher level by some calculational means. As a response to a bandwidth change command the speech encoder 204 and decoder 220 switch to encoding and decoding procedures that correspond to the new bandwidth, and simultaneously the switching blocks 203 and 221 select either the direct couplings (in the case of wider bandwidth) or those going through the downsampling block 203 and upsampling block 222 (in the case of narrower bandwidth). Multiple bandwidths can be achieved by programming the speech encoder 204 and decoder 220 for multiple bandwidths and by providing multiple parallel downsampling blocks in the transmitting station and upsampling blocks in the receiving station (or by programming the downsampling block 203 and upsampling block 222 for multiple down/upsampling ratios).

The existing definitions of the AMR arrangements include the drawback that changing from one source encoding bandwidth to another tends to cause noticeable artefacts in the transmitted signal. For example changing between two different speech codec modes with different bandwidths causes the listening user at the receiving end to notice a strange audible effect in the speaker's voice.

As additional background to the invention we describe briefly the known Tandem Free Operation or TFO arrangement which is used to convey a connection between mobile terminals (a MS-MS-connection, where MS comes from Mobile Station) where wideband speech coding is used. For the sake of brevity we will denote a signal that carries speech encoded with wideband (narrowband) speech coding simply as wideband (narrowband) speech.

The use of two complete encoder-decoder pairs which was described in association of FIG. 1 is known as tandem operation and it is necessary especially if the network connection 115 goes through a public switched telephone network or PSTN of generally unknown nature. In a more advantageous case the terminals 100 and 130 are both mobile stations of a digital cellular radio system, and the network connection 115 is truly digital and capable of establishing transparent digital channels between certain transcoder and rate adaptor units or TRAUs that operate either within base stations or under the control of base stations.

FIG. 3 illustrates an arrangement where a first TRAU 300 is functionally associated with the first base station 110 and a second TRAU 310 is functionally associated with the second base station 120. Each TRAU 300 and 310 comprises a decoder 301, 311; an uplink TFO unit 302, 312; an encoder 303, 313; a downlink TFO unit 304, 314; and a TFO Protocol unit 305, 315. In each TRAU the decoder 301, 311 and uplink TFO unit 302, 312 are coupled in parallel to receive the uplink frames from the mobile station, and their outputs are combined through the use of a combiner 306, 316. Similarly the encoder 303, 313 and downlink TFO unit 304, 314 are coupled in parallel to receive the transmission frames from the other TRAU, and their outputs go through a selection switch 307, 317. The digital network 320 consists of IPEs (In Path Equipment), of which the IPEs 321 and 322 are shown, and is capable of establishing transparent 64 kbit/s channels in both directions between the TRAUs. The first base station 110 operates under the control of a first base station controller 330, which in turn is part of a communication domain governed by a first mobile services switching centre 340. The second base station 120 operates under the control of a second base station controller 350, which in is part of a communication domain governed by a second mobile services switching centre 360. There are control connections from the base station controllers 330 and 350 to respective ones of the TFO Protocol units 305 and 315.

The document "GSM 04.53 version 1.6.0 (1998-10); Digital cellular telecommunications system (Phase 2+); Inband Tandem Free Operation (TFO) of Speech Codecs; Service Description; Stage 3", published by the ETSI (European Telecommunications Standards Institute) and incorporated herein by reference, defines an inband signalling protocol for testing for the transparency of the channels, the TFO supporting capability of both TRAUs and the identicality of speech codecs at both radio interfaces. Given that the tests succeed, the TFO Protocol units 305 and 315 establish the TFO connection by commanding the signal paths to go transparent and bypassing the decoder/encoder functions within the TRAUs 300 and 310. The TFO specifications also define a fast fall back procedure for sudden TFO interruption and provide support for resolution in codec mismatch situations and cost efficient transmission within the fixed part 320 of the network.

The first mobile station 370 which communicates with the first base station 110 comprises an encoder 371 and a decoder 372. Correspondingly the second mobile station 380 which communicates with the second base station 120 comprises a decoder 381 and an encoder 382. The TFO procedures referred to above serve to establish a virtually transparent connection from the encoder 371 of the first mobile station 370 to the decoder 381 of the second mobile station 380 and from the encoder 382 of the second mobile station 380 to the decoder 372 of the first mobile station 370.

SUMMARY OF THE INVENTION

It is an object of the invention to present a method and an arrangement for changing source bandwidths without the above-described drawbacks of the prior art arrangements. It is an additional object of the invention to present a method and an arrangement for changing source bandwidths so that the human users at the ends of a telephone connection notice essentially no audible artefacts due to bandwidth changes. Another object of the invention is to present a method and an arrangement of the above-described kind with only a reasonable level of complexity in implementation.

The objects of the invention are achieved by introducing the concept of soft bandwidth switching, where the acoustic bandwidth is gradually changed from a first level that corresponds to a first codec mode to a second level that corresponds to a second codec mode.

The method for changing the bandwidth of a speech signal in association with multiple mode encoding or decoding according to the invention is characterized in that it comprises the steps of:

- receiving an instruction for changing speech signal bandwidth and
- gradually changing the bandwidth of a speech signal processed in a multiple mode speech encoding or decoding arrangement as a response to said instruction for changing speech signal bandwidth.

The invention applies also to a speech encoding arrangement comprising:

- a speech signal input and
- a multiple mode speech encoder for encoding speech signals coupled to the speech signal input selectabily with a first encoding mode associated with a first bandwidth or a second encoding mode associated with a second bandwidth;

it is characterized in that it comprises a soft bandwidth switching block with an input coupled to the speech signal input and an output coupled to the multiple mode speech encoder, said soft bandwidth switching block being arranged to gradually change the bandwidth of a speech signal coupled to the multiple mode speech encoder as a response to an instruction for changing speech signal bandwidth.

The invention applies further to a speech decoding arrangement comprising a speech signal input and a multiple mode speech decoder for decoding speech signals coupled to the speech signal input selectabily with a first decoding rate associated with a first bandwidth or a second decoding rate associated with a second bandwidth;

it is characterized in that it comprises a soft bandwidth switching block with an input coupled to the multiple mode speech decoder and an output, said soft bandwidth switching block being arranged to gradually change the bandwidth of a speech signal received from the multiple mode speech decoder as a response to an instruction for changing speech signal bandwidth.

Additionally the invention applies to a digital radio telephone and a transcoder and rate adaptor unit of a cellular radio system which have the characteristic feature of comprising at least one of a speech encoding arrangement or a speech decoding arrangement of the above-described kind.

In a vast majority of telephone applications the acoustic signal conveyed through a connection is speech, so instead of general acoustic bandwidth we may talk about the speech bandwidth. However, the use of the term "speech" should not be construed as a limitation to the applicability of the invention.

A natural speech signal comprises a wide range of frequency components, and reducing the speech bandwidth inevitably removes some of these components causing various amounts of distortion. In the existing systems there may occur a switching moment during active speech so that the speech bandwidth changes abruptly. This causes audible artefacts, because the amount and nature of distortion also changes abruptly. According to the invention there is introduced a smoothing period during which the speech bandwidth changes gradually. The human sensory system does not perceive gradual changes in speech distortion as easily as abrupt changes, so the smoothing period improves the auditory impression that the users get.

The invention may be applied in an encoding device, where the smoothing period is most advantageously introduced before the actual speech encoder or as a part thereof. The invention may also be applied in a decoding device, where the smoothing period is most advantageously introduced after the actual speech decoder or as a part thereof. In both cases (encoding device or decoding device) the means for introducing the smoothing period typically comprise adjustable gain units on parallel signal paths, each of which conveys a part of the acoustic spectrum. The adjustable gain units may be replaced or complemented with adjustable filters on said signal paths.

Regarding larger speech (or acoustic) bandwidths, the additional frequency components may not always be available due to the nature and operation of the communication system where the invention is applied. Therefore the arrangement according to the invention advantageously comprises a noise generator that can be used to replace missing additional frequency components. The wideband speech (or acoustic) signal is then a weighted combination of basic frequency components, additional frequency components and noise.

BRIEF DESCRIPTION OF DRAWINGS

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

The contents of FIGS. 1 to 3 were explained in the description of prior art, so the following description of the invention and its advantageous embodiments focuses on FIGS. 4 to 8. Same reference designators designate similar parts in the drawings.

DETAILED DESCRIPTION OF THE INVENTION

Figure 3:
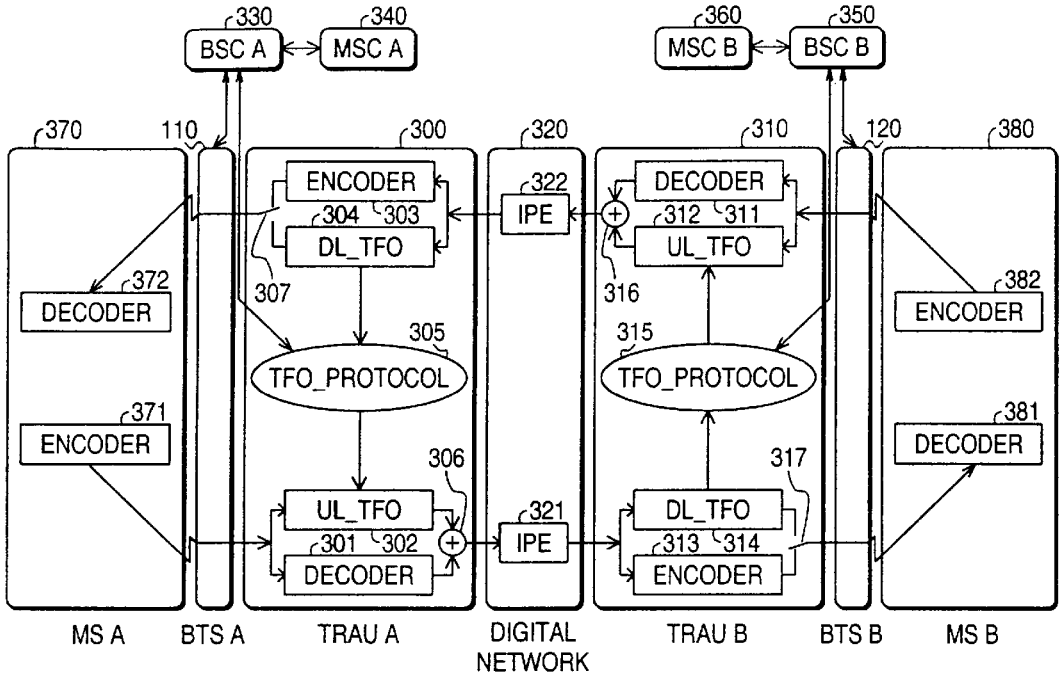
Fig. 3 PRIOR ART
FIG. 3 illustrates a known arrangement for Tandem Free Operation.
Figure 4:
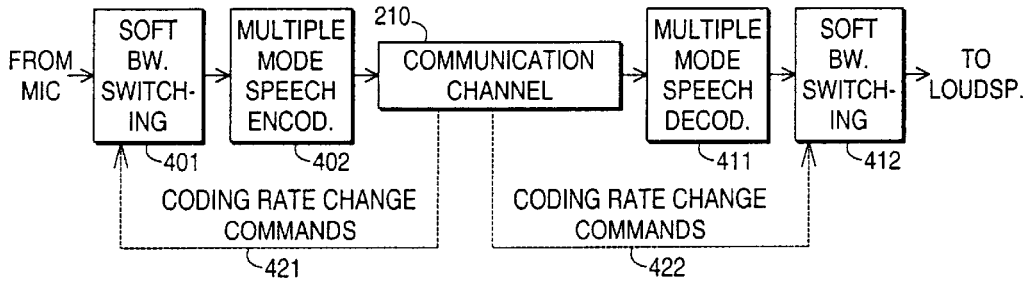
FIG. 4 illustrates a principle according to an embodiment of the invention.

FIG. 4 illustrates an encoding—decoding device pair coupled together through a communication channel 210 which comprises generally e.g. all necessary channel encoding/decoding and transmitting/receiving arrangements. Blocks 401 and 402 are parts of an encoding device, and blocks 411 and 412 are parts of a decoding device. The encoding and decoding devices in FIG. 4 may represent any combination of the encoding and decoding devices on a single signal path in e.g. a communication arrangement like that in FIG. 3.

Figure 1:
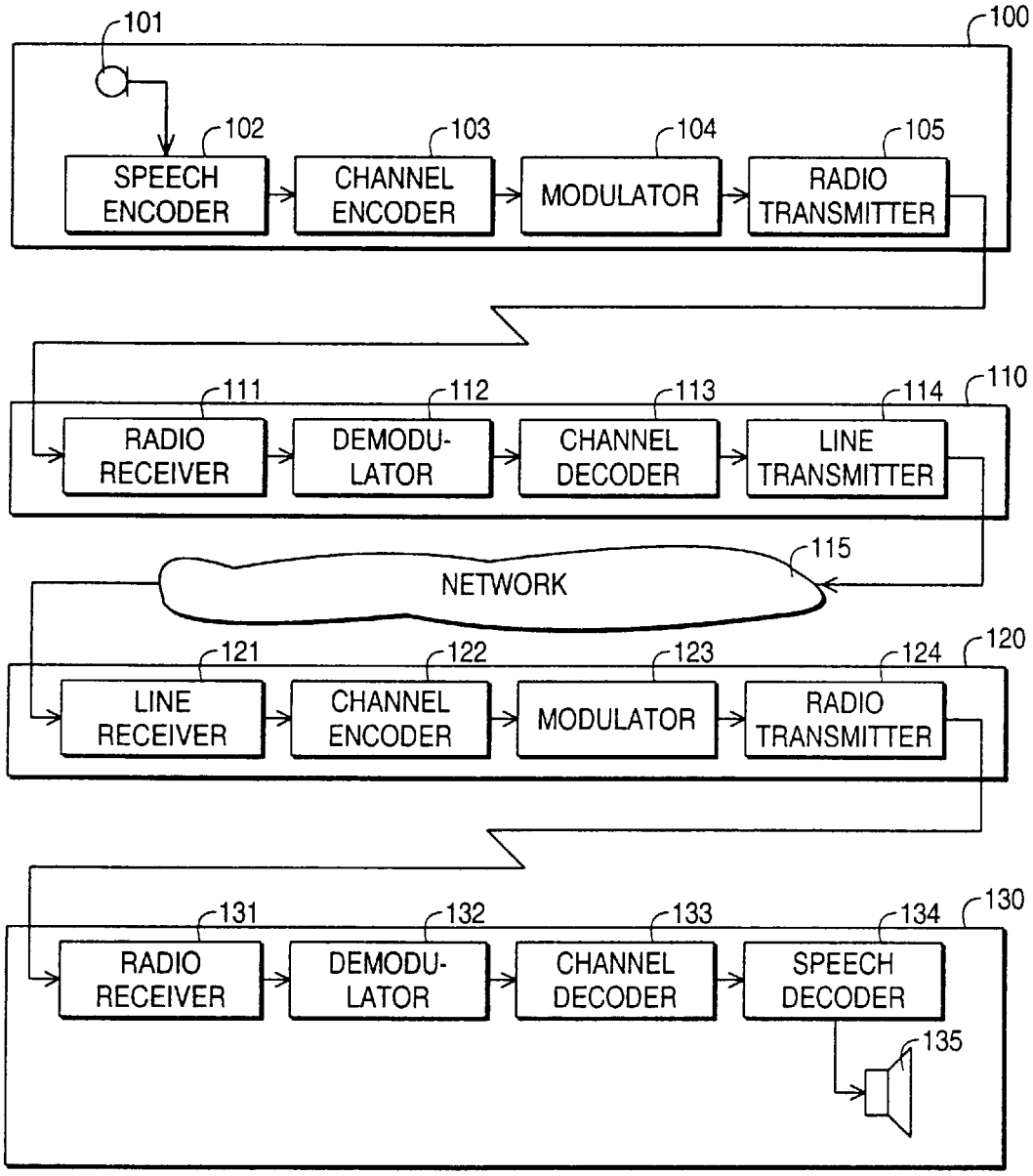
Fig. 1 PRIOR ART
FIG. 1 illustrates the known concept of speech transmission in a communication system.
Figure 2:
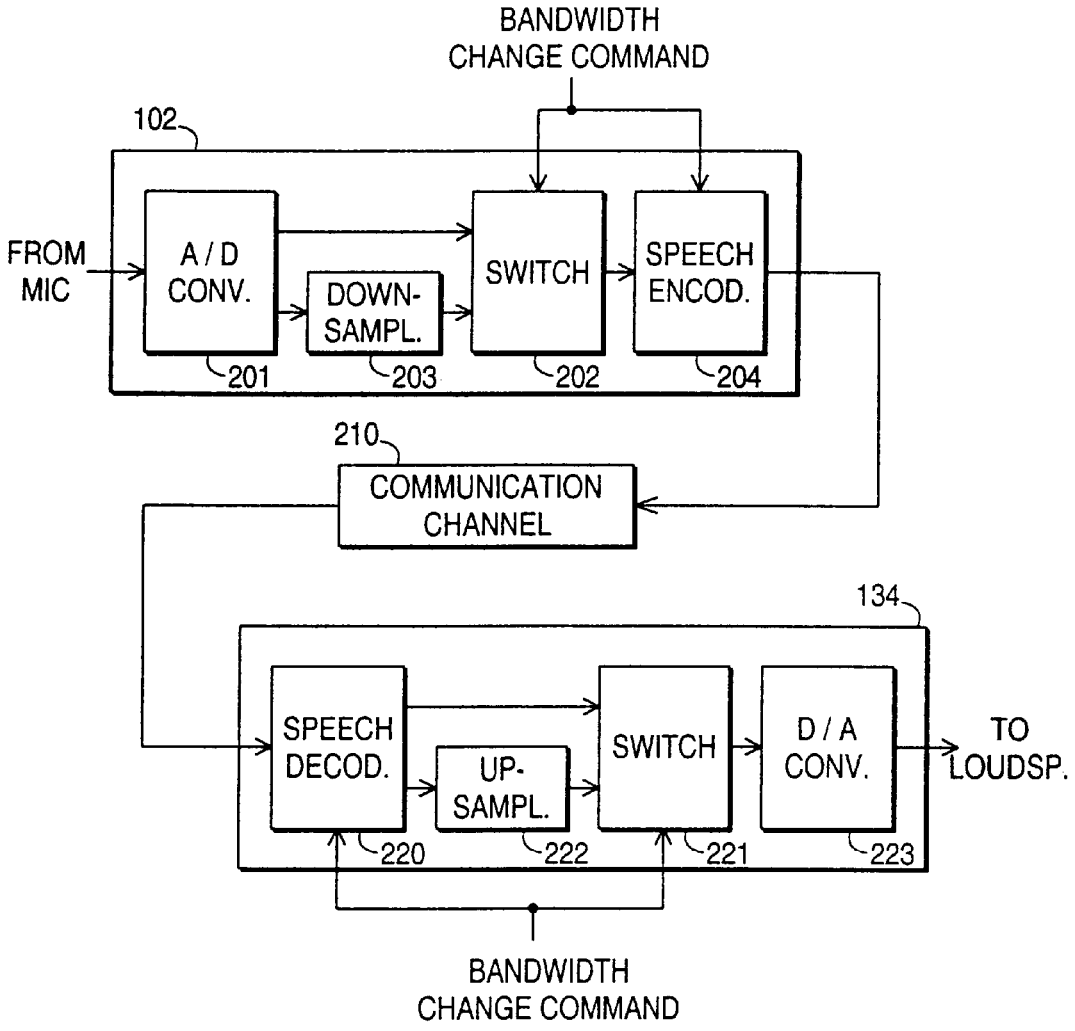
Fig. 2 PRIOR ART
FIG. 2 illustrates some exemplary known structures for multirate coding.

Within the encoding device there is a soft bandwidth switching block 401 and a multiple bandwidth speech encoder 402, of which the latter may be similar to the speech encoder proper 204 in FIG. 2. Within the decoding device there is a multiple bandwidth speech decoder 411 and soft bandwidth switching block 412, of which the former may be similar to the speech decoder proper 220 in FIG. 2. The invention does not require that there is a soft bandwidth switching block simultaneously both in the encoding device and in the decoding device; these blocks appear both in FIG. 4 only to illustrate the applicability of the invention in multiple locations of the signal transmission chain.

The communication channel 210 comprises, among others, the controllers that are responsible for giving bandwidth change commands. In FIG. 4 the control connections 421 and 422 illustrate the reception of such commands both at the encoding device and at the decoding device. The invention does not limit the form in which such commands are given, although in some embodiments of the invention it is advantageous if at least some of the bandwidth change commands come in two parts so that there comes first a warning about an approaching bandwidth change command and only a certain time thereafter the command proper.

The task of both soft bandwidth switching blocks 401 and 412 in FIG. 2, or that one of these blocks which is used in a practical communication situation, is to implement a smoothing period between bandwidth changes so that the input speech bandwidth at the encoding device and/or the output speech bandwidth at the decoding device do not change abruptly. In the following we describe an exemplary hardware implementation of blocks 401 and 412.

Figure 5:
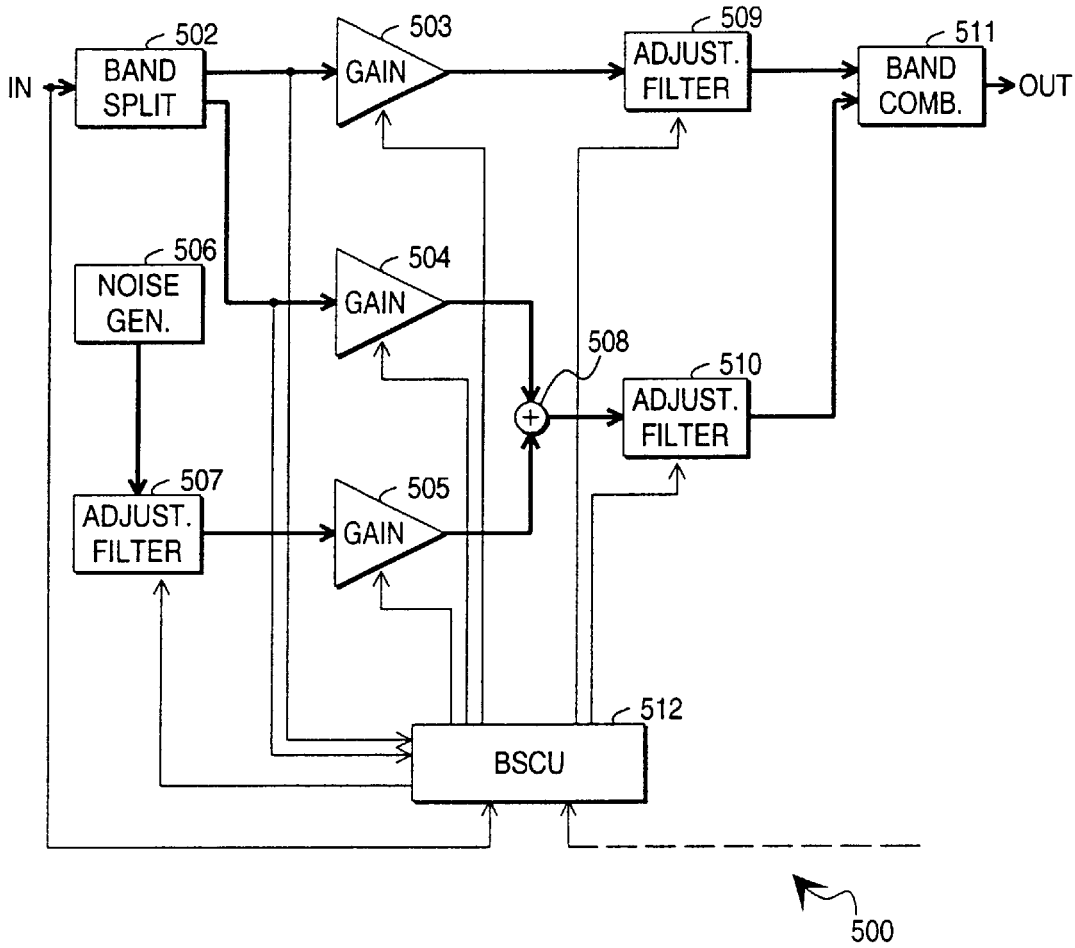
FIG. 5 illustrates a soft bandwidth switching arrangement according to an embodiment of the invention.

FIG. 5 is a functional block diagram of a soft bandwidth switching block which may be used as the block 401 in an encoding device or as the block 412 in a decoding device when some changes in the flow of signals are taken into account. Thick lines between functional blocks denote signal paths and thin lines denote control connections. An input signal is coupled to the input of a band splitter 502. In a transmitting mobile station the input signal is the initial, unencoded speech signal coming from an A/D converter, while in a receiving mobile station or uplink TRAU (where TFO is not in use) the input signal is the output of a speech decoder. In a downlink TRAU where TFO is not in use the input signal is the PCM sample train coming through the network. The band splitter has as many outputs as there are frequency bands that need to be treated separately. Typically the number of outputs from the band splitter 502 is equal to the number of bandwidths which have been defined in the speech coding arrangement to which the invention is applied. In the exemplary soft bandwidth switching block of FIG. 5 there are two outputs from the band splitter 502, and each of these is coupled to the input of an adjustable gain unit 503 or 504 of its own. Additionally there is a third adjustable gain unit 505 the input of which is coupled to the output of a white noise generator 506 through a first adjustable filter 507.

For the sake of brevity we denote the outputs of the band splitter 502 as the lower band output and the upper band output. If we place the soft bandwidth switching block of FIG. 5 e.g. into the known context of two selectable speech bandwidths mentioned in the description of prior art, the lower band output carries that part of the input speech signal that only goes into the 3.5 kHz frequency band, and the upper band output carries that part of the input speech signal that only contains the bandwidth from 3.5 kHz to 7 kHz. The lower band output is coupled to the first adjustable gain unit 503 and the upper band output is coupled to the second adjustable gain unit 504. The outputs of the second adjustable gain unit 504 and the third adjustable gain unit 505 are coupled to the inputs of a combiner 508 while the output of the first adjustable gain unit 503 is coupled to the input of a second adjustable filter 509. The output of said combiner 508 is coupled to the input of a third adjustable filter 510. The outputs of the second and third adjustable filters 509 and 510 are both coupled to the inputs of a band combiner 511, which is a mirror image of the band splitter 502. The output of the band combiner 511 constitutes the output of the whole soft bandwidth switching block of FIG. 5.

In a transmitting mobile station or a downlink TRAU (where TFO is not in use) the output signal is the input signal to the actual speech encoder. In a receiving mobile station the output signal is the input signal to a D/A converter. In an uplink TRAU (where TFO is not in use) the output signal is the PCM sample train to be transmitted through the network.

A bandwidth switching control unit or BSCU 512 is coupled to receive input information from the input and outputs of block 502 as well as from certain other parts of the encoding or decoding device; the latter kind of input comprises at least the commands for changing bandwidths, but it may also comprise speech parameters that characterize the transmitted speech signal at some other stage of transmission. The BSCU 512 is also coupled to control the operation of blocks 503, 504, 505, 507, 509 and 510.

The arrangement of FIG. 5 functions as follows. The band splitter 502 divides the input signal into two frequency bands; the term "frequency band" must here be understood in a wide sense since, as an alternative to some continuous frequency range between a lower band limit and upper band limit, each output frequency band produced by the band splitter 502 may comprise several frequency components or subbands taken from various locations of the speech spectrum. One of these frequency bands, denoted here as the lower band, is the one which should always be present in an encoded speech signal. The other frequency band which here is denoted as the upper band should only be present in the encoded speech signal if the wider one of two selectable speech bandwidths is employed.

The white noise generator 506 and first adjustable filter 507 together generate a so-called artificial upper band signal which can be used as a substitute to a missing actual upper band signal. The purpose of the first adjustable filter 507 is to modify the completely arbitrary noise signal coming from the white noise generator 506 e.g. to shape its spectrum so that the artificial upper band signal would resemble an assumed actual upper band speech signal and/or to remove those frequency components that would overlap with the existing lower band signal. The speech encoding process that takes place after the soft bandwidth switching block of FIG. 5 in an encoding device, and the speech decoding process that takes place before the soft bandwidth switching block in a decoding device, typically relies on the linear predictive coding or LPC principle where filtering is performed in a way known as such according to certain LPC coefficients. The same LPC coefficients or a part thereof may be used in adjusting the first adjustable filter 507. Alternatively, there may be applied the principle of LPC (or LP for short) filter extrapolation, which is disclosed in a co-pending patent application number FI 20000524, with the title "Speech decoder and a method for decoding speech", which is incorporated herein by reference.

The band combiner 511 simply combines the filtered signals coming from the second and third adjustable filters 509 and 510 to form a common output signal for the soft bandwidth switching block of FIG. 5.

The BSCU 512 sets the gain factors of the adjustable gain units 503, 504 and 505, and adjusts the adjustable filters 507, 509 and 510. For the sake of simplicity we may assume that the gain factor of each adjustable gain unit is between zero and one, so that with a gain factor one the signal passes through unaffected, with a gain factor zero no signal passes through and with some gain factor therebetween the amplitude (or power, or some other characteristic) of the signal coming through is the corresponding fraction of that of the unaffected signal. The second and third adjustable filters 509 and 510 filter the outputs of the first adjustable gain unit 503 and the combiner 508 respectively. The adjustability of the filters means that the pass band of each filter may be set separately to be anything between zero and the full width of the frequency band that corresponds to the highest speech encoding rate. The functions of the adjustable gain units 503, 504 and 505 on one hand and those of the second and third adjustable filters 509 and 510 on the other hand are partly complementary to each other, because both change the relative strengths of the lower band, upper band and artificial upper band signals at the output of the soft bandwidth switching block 401. It is not necessary to use both adjustable gain units and adjustable filters; only one of these is enough to implement the soft bandwidth switching functionality according to the present invention.

The setting of the gain factors of the adjustable gain units 503, 504 and 505, and the pass bands of the second and third adjustable filters 509 and 510 if necessary, is based on an analysis of the input signal as well as the upper and lower band signals which the BSCU 512 receives through the control information couplings shown in FIG. 5. The effect of the control information to the adjusting process will be explained in more detail later. The BSCU of an encoder arrangement may also receive some control information from the speech encoder proper and the speech parameters coming through the connection shown as 421 in FIG. 4; these connections are shown as a dashed line in FIG. 5. The BSCU of a decoder arrangement can receive the speech parameters through the control connection from the input of the soft bandwidth switching block.

A "soft" change in bandwidth according to the invention means a gradual change between encoding or decoding modes characterized by the use of different bandwidths. An opposite thereof is a "hard" or abrupt change which is more or less a characteristic of prior art arrangements. Depending on whether the soft bandwidth switching block is located in a transmitting mobile station, an uplink TRAU, a downlink TRAU or a receiving mobile station the soft and hard changes have certain specific characteristics. In the following we discuss these characteristics case by case.

1. Encoder, switching from wideband to narrowband

1A: Encoder in uplink MS or encoder in downlink TRAU, hard change

As mentioned above, a hard change from wideband to narrowband means that there is received a command for entering a narrowband mode where the encoder must immediately start producing parameters representing the narrowband speech. No wideband information at all may be transmitted from the uplink MS or downlink TRAU after it has received the mode switching command. If one wants to accomplish smoothing, it must be done in the decoder.

1B: Encoder in uplink MS, soft change

This case differs from case 1A in that either the uplink MS is allowed to delay the execution of the mode switching command or it receives an early warning of an oncoming mode switching command so that it may start smoothing the change between bandwidths before the actual command comes. The result is a discrete smoothing period during which the soft bandwidth switching block in the encoder of the MS performs a gradual change from wideband to narrowband. The length of the smoothing period is not limited by the invention; it may be a predefined constant or dynamically changeable. At the priority date of this patent application it is assumed that a suitable maximum length for the smoothing period could be one second. The gradual change is in practice achieved so that the bandwidth switching control unit or BSCU 512 gradually decreases the gain of the adjustable gain block 504 to zero or adjusts the adjustable filter 510 so as to gradually mute the upper frequency band. Adjustments to the operation of blocks 504 and 510 can even be made simultaneously. In the uplink MS the wideband speech encoding mode has been based on truly encoding speech on a wide frequency band, so blocks 505, 506 and 507 have not been in use and they are also not used during the smoothing period. Throughout the smoothing period the speech encoding arrangement in the uplink MS continues to operate in the wideband encoding mode, but immediately after the smoothing period it may be changed to operate in the narrowband mode.

1C: Encoder in downlink TRAU, soft change

This case may be further divided into subcases depending on whether the downlink TRAU has been receiving wideband or narrowband input information through the network and whether or not TFO is in use. In typical existing networks at the priority date of this application, receiving wideband input information from the network is synonymous to using TFO, but it is possible to build a network conveying wideband speech even without TFO. During the use of TFO the encoder in the downlink TRAU does not have an active role, because the original wideband speech signal from the uplink MS is transmitted transparently through the network. However, the encoder must be running in order to guarantee a fast fall-back position should TFO fail. The output of the wideband encoder in the downlink TRAU is only used if TFO is not operative. Certain considerations given above in case 1B apply: the downlink TRAU is either allowed to delay the execution of a mode switching command or it receives an early warning of an oncoming mode switching command so that it may start smoothing the change between bandwidths before the actual command comes, the length of the smoothing period may be constant or dynamically changeable, and a typical maximum value for the duration of the smoothing period is assumed to be one second. If the downlink TRAU has been receiving wideband speech from the network, even the practical implementation of the smoothing period is similar. However, if the downlink TRAU has been receiving only narrowband speech from the network, it has been producing an artificial upper band by using blocks 505, 506 and 507. In such a subcase the BSCU 512 accomplishes the smoothing by gradually decreasing the gain of the adjustable gain block 505 to zero and/or adjusting the adjustable filter 507 and/or adjusting the adjustable filter 510 so as to gradually mute the artificial upper frequency band.

2. Encoder, switching from narrowband to wideband

2A: Encoder in uplink MS, hard or soft change

The speech encoder is set to wideband mode immediately after the uplink MS has received the mode switching command. However, the BSCU 512 changes the gain of the adjustable gain unit 504 so that at the moment of changing modes the gain is zero or at least small, and during the smoothing period it is gradually increased to the value which it should have in active wideband operation, e.g. one. The same effect can be achieved by gradually adjusting the adjustable filter 510 during the smoothing period so that at the moment of changing modes the upper band is essentially muted and at the end of the smoothing period the upper band has a meaningful width and amplitude. The length of the smoothing period determines the "hardness" of the change and it may be selected according to the contents of the input speech information; hence the control connection from the input to the BSCU in FIG. 5. For example if there is a temporary silent period in the speech signal the change may be very fast, but if there is a very unvoiced signal like an "s"-sound in the speech, a relatively slow change is advantageous in order not to produce a clearly audible artefact. An alternative or additional criterion to be considered in selecting the length of the smoothing period is the number and/or frequency of recent changes in either direction between wideband and narrowband modes. A correspondence representing a subjective optimum between certain numbers and/or frequencies of recent changes and respective smoothing period lengths may be found by experimenting.

2B: Encoder in downlink TRAU, hard or soft change

As in case 2A, the speech encoder is set to wideband mode immediately after the downlink TRAU has received the mode switching command. The BSCU 512 changes the gain of an adjustable gain unit handling the upper frequency band so that at the moment of changing modes the gain is zero or at least small, and during the smoothing period it is gradually increased to the value which it should have in active wideband operation, e.g. one. The choice between whether the adjustable gain unit concerned is block 504 or 505 depends on whether the downlink TRAU receives wideband or narrowband speech from the network. Also adjustable filter 510 can be used to implement the gradual change, or even adjustable filter 507 if an artificial upper band is to be generated. The length of the smoothing period may be selected according to the contents of the input speech information and/or the number and/or frequency of recent changes in either direction between wideband and narrowband modes. The remarks concerning TFO presented in case 1C apply also in this case.

3. Decoder, switching from wideband to narrowband

3A: Decoder in uplink TRAU, hard or soft change

In the existing networks the uplink TRAU can only transmit a wideband speech signal during TFO, where the decoder is by-passed. Therefore the invention does not have an effect on the operation of a decoder in the uplink TRAU in this case, as long as the uplink TRAU follows the known procedures regarding TFO and narrowband transmission. However, for the sake of completeness we may assume that in some future network solutions it would be possible for the uplink TRAU to transmit a wideband speech signal also without TFO, in which case the decoder of the uplink TRAU should perform at least some of the operations described below in association with the decoder of the downlink MS.

3B: Decoder in downlink MS, hard change

The change being hard means now that after a period of receiving wideband speech the speech decoder of the downlink MS suddenly gets a command of changing decoding mode and starts receiving only a narrowband speech signal without knowing beforehand that the change is coming. Due to the invention the downlink MS may still smoothe the result of the change in the decoded speech by producing an artificial upper band signal which can then be gradually muted. Immediately after the change the noise generator 506 is generating a noise signal which is filtered in the adjustable filter 507 in order to shape its spectrum correctly. Also immediately after the change the gain of block 505 is one or at least relatively high, while the gain of block 504 is zero because no actual upper band speech signal is available from the band splitter 502. Gradually muting the artificial upper band signal means decreasing the gain of block 505 to zero or at least a relatively low value. The speed of decreasing the gain may again be determined according to a variety of criteria; e.g. the contents of the speed signal or the number and/or frequency of recent changes in decoding mode (see case 2A).

3C: Decoder in downlink MS, soft change

This case differs from case 3B in that the decoder in the downlink MS receives an early warning about an oncoming change in decoding mode. We may first assume that the warning comes early enough so that the change can be fully accomplished by handling only the actual speech signal. We may further assume that a smoothing period of X milliseconds will be used, where X is a positive real number known to the downlink MS. Under these assumptions the gain of block 505 can be kept at zero (or a relatively low value) throughout the change. Exactly X milliseconds before the announced change instant the BSCU 512 starts decresing the gain of block 504 from one (or a relatively high value) towards zero (or a relatively low value) so that the lower value is reached at the change instant and the narrowband decoding mode can be entered. If we then release our first assumption we may define more generally that for the duration of X1 milliseconds before the change instant the gain of block 504 is decreased and the gain of block 505 is kept at zero (or a relatively low value), exactly at the change instant the roles and gain factors of blocks 504 and 505 are reversed and block 506 starts feeding noise through blocks 507, 505 and 508 to the (artificial) upper band, and for the duration of X2 milliseconds after the change the gain of block 505 is decreased to zero (or a relatively low value). Keeping in line with our second assumption, X1+X2=X so that this case boils down to case 3B if X1=0.

4. Decoder, switching from narrowband to wideband

4A: Decoder in uplink TRAU, hard or soft change

The decoder in the uplink TRAU may obey the commands regarding wideband or narrowband mode, but in existing networks the output thereof must be limited to narrowband (3.5 kHz) regardless of the mode because a wider band can not be transmitted over a PSTN. Wideband speech may be transmitted during TFO, but then the decoder in the uplink TRAU is again by-passed. Therefore the invention does not have an effect here more than in case 3A. For the sake of completeness the same considerations about possible future networks apply.

4B: Decoder in downlink MS, hard or soft change

The change means now that after a period of receiving narrowband speech the speech decoder of the downlink MS gets a command of changing decoding mode and starts receiving a wideband speech signal with or without knowing beforehand that the change is coming. The most advantageous embodiment of the invention is to accomplish the change in decoding mode at the change instant but keep the gain of block 504 first at zero (or at a relatively low value) and gradually increase it to one (or a relatively high value). The speed of increasing the gain can be made dependent on the contents of the speech signal and/or the number and/or frequency of recent changes in decoding mode (see case 2A). If an early warning comes about an oncoming change, it would basically be possible to "pre-ramp" up the upper band by producing a shaped noise signal in blocks 506 and 507 and gradually increasing the gain of block 505 before the change instant while keeping the gain of block 504 low. At the change instant the roles and gain factors of blocks 504 and 505 would then be reversed. However, using first an artificially produced upper band and only thereafter the actual upper band is typically more prone to producing audible artefacts than using the actual upper band alone.

Figure 6:
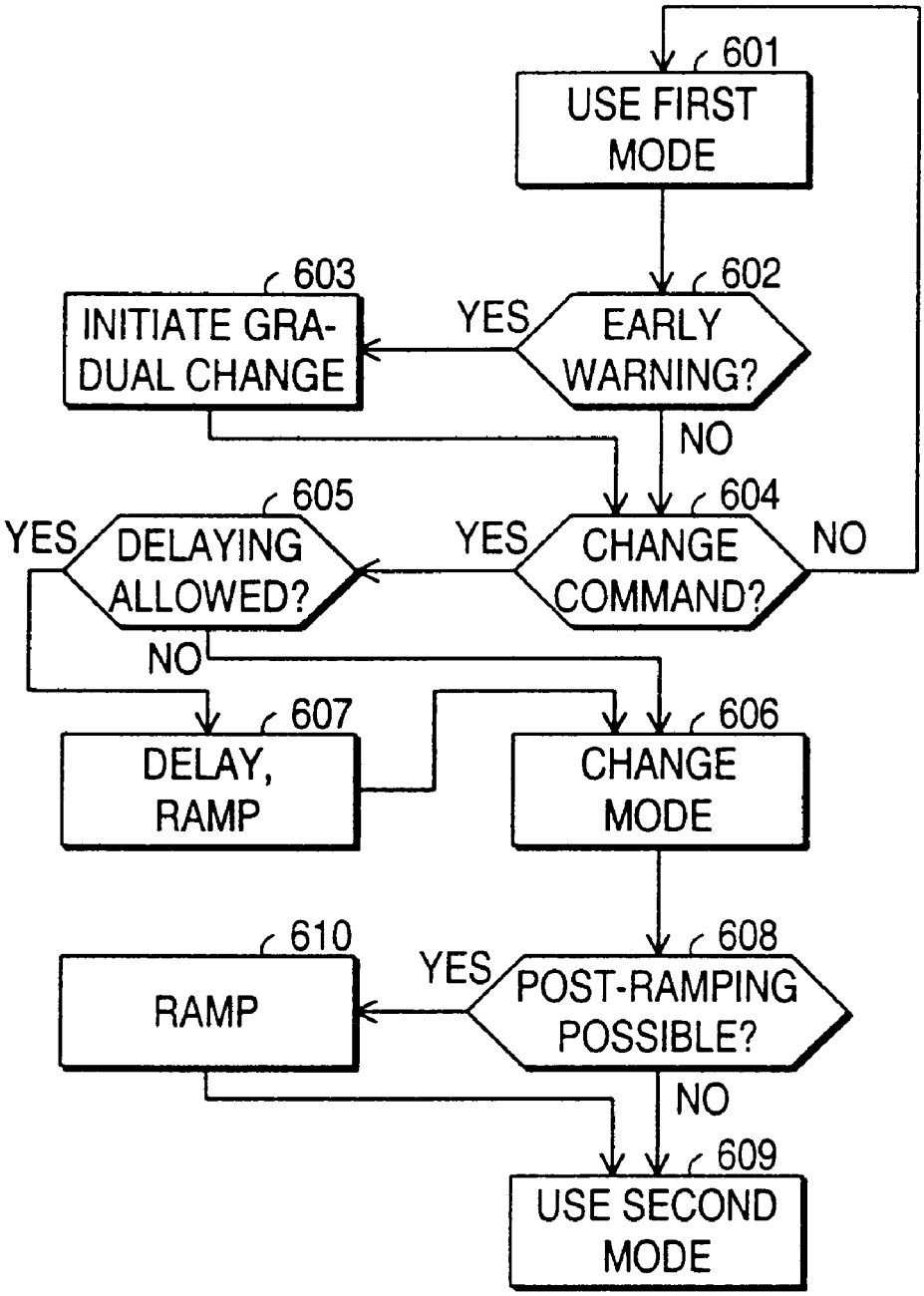
FIG. 6 illustrates a method according to an embodiment of the invention.

FIG. 6 is a general flow diagram illustrating a change from the use of a first encoding or decoding mode to a second encoding or decoding mode. At step 601 the encoder (decoder) is encoding (decoding) using its first mode, which in the above-treated context is either the narrowband mode or the wideband mode. Step 602 is a check whether an early warning has been received about an oncoming change of modes. If such an early warning has been received, the gradual change of bandwidths is initiated according to step 603 in the soft bandwidth switching unit associated with the encoder (decoder). Step 604 is a check whether a command to change modes has been received. In the absence of both early warnings and commands the encoding (decoding) arrangement is constantly looping through steps 601, 602 and 604. Here we assume that if an early warning has been received, also a command to change modes will be received; coming from step 603 to step 604 and jumping back to step 601 would obviously result in error.

When the command to change modes has been received, the encoding (decoding) arrangement checks at step 605 whether it is possible to delay the execution of the command. If not, an immediate change in encoding (decoding) mode is made at step 606. If it is found to be possible to delay the execution of the command, soft bandwidth switching or "ramping" is initiated according to step 607 and step 606 is performed only after the appropriate delay. At step 608 it is checked, whether an already accomplished change in the encoding (decoding) mode can be complemented with a "post-ramping" step where the soft bandwidth switching unit gradually changes the bandwidth after the change in the encoding (decoding) mode. If not, encoding (decoding) with the second encoding (decoding) mode is continued as such at step 609. If post-ramping is found to be possible, it is performed at step 610.

The cases 1A to 4B described above correspond to slightly different paths through the flow diagram of FIG. 6 according to the following lists of steps.

1A: 601–602-604–605-606–608-609.
1B and 1C, without early warning: 601–602-604–605-607–606-608–609.
1B and 1C, with early warning: 601–602–603–604–605–606–608–609.
2A and 2B: 601–602–604–605–606–608–610–609.
3A, existing networks: 601–602–604–605–606–608–609.
3B: 601–602–604–605–606–608–610–609.
3C, without early warning: as in 3B.
3C, with early warning: 601–602–603–604–605–606–608-(610)-609.
4A, existing networks: 601–602–604–605–606–608–609.
4B: 601–602–604–605–606–608–610–609.

The appearance of step 610 in parentheses means the possible case where there is not enough time to complete the pre-ramping step before the change in modes, so that the interrupted ramping process must be continued as post-ramping.

Figure 7:
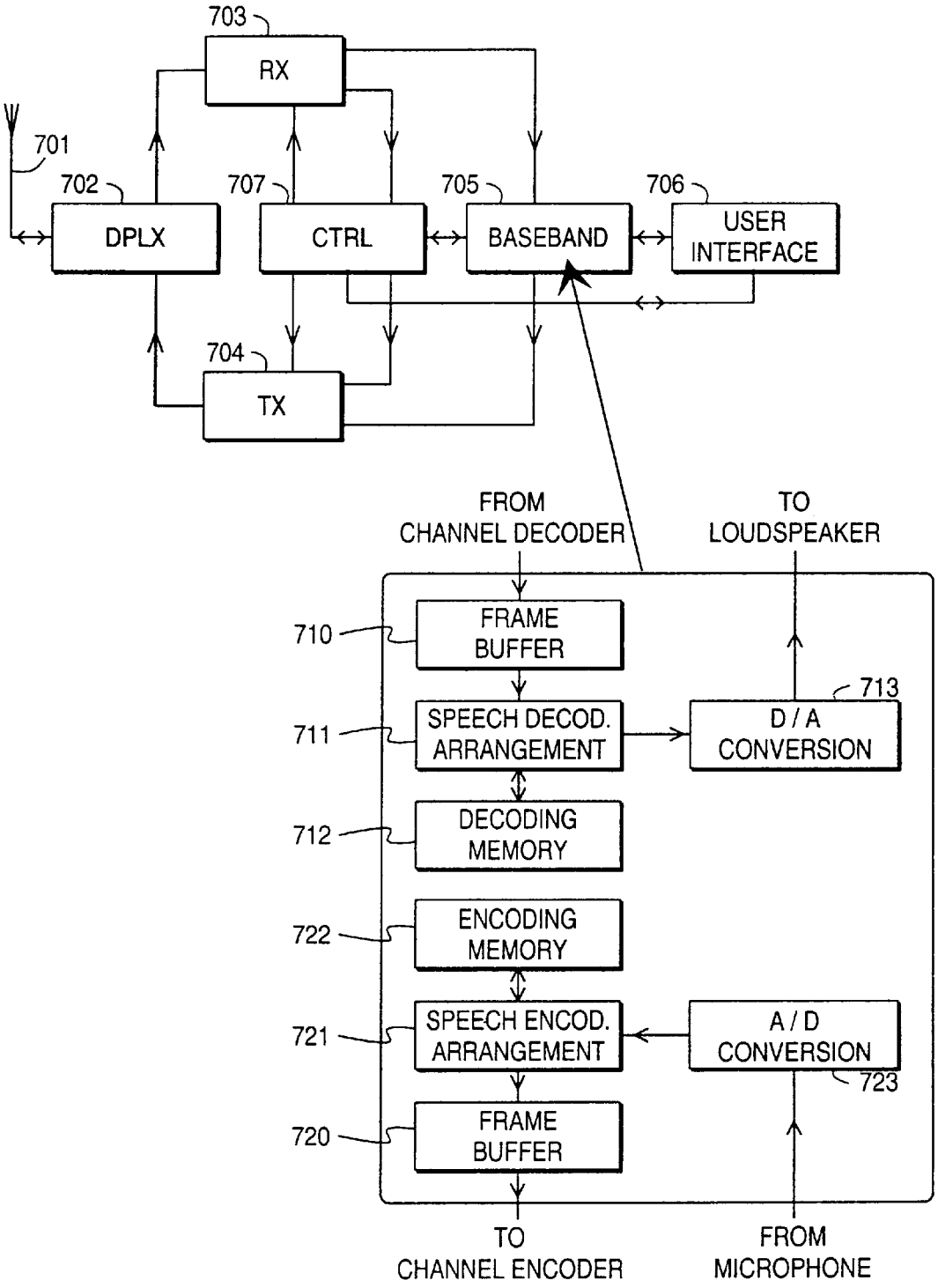
FIG. 7 illustrates a mobile telecommunication terminal according to an embodiment of the invention and FIG. 8 illustrates parts of a base station subsystem according to an embodiment of the invention.

A speech encoder or decoder alone is not enough for translating the spirit of the invention into advantages conceivable to a human user. FIG. 7 illustrates a digital radio telephone where an antenna 701 is coupled to a duplex filter 702 which in turn is coupled both to a receiving block 703 and a transmitting block 704 for receiving and transmitting digitally coded speech over a radio interface. The receiving block 703 and transmitting block 704 are both coupled to a controller block 707 for conveying received control information and control information to be transmitted respectively. Additionally the receiving block 703 and transmitting block 704 are coupled to a baseband block 705 which comprises the baseband frequency functions for processing received speech and speech to be transmitted respectively. The baseband block 705 and the controller block 707 are coupled to a user interface 706 which typically consists of a microphone, a loudspeaker, a keypad and a display (not specifically shown in FIG. 7).

A part of the baseband block 705 is shown in more detail in FIG. 7. The last part of the receiving block 703 is a channel decoder the output of which consists of channel decoded speech frames that need to be subjected to speech decoding, speech synthesis and D/A conversion. The speech frames obtained from the channel decoder are temporarily stored in a frame buffer 710 and read therefrom to the actual speech decoding arrangement 711. The latter implements a speech decoding algorithm read from a memory 712. In accordance with an advantageous embodiment of the invention, the speech decoding arrangement 711 comprises, after the speech decoder proper, a soft bandwidth switching unit of the type shown in FIG. 5 in order to implement soft bandwidth switching when the digital radio telephone of FIG. 7 acts as the downlink MS.

The recorded speech from the microphone is A/D converted in an A/D converter block 723. A speech encoding arrangement 721 performs the speech encoding according to an encoding algorithm read from a memory 722. The encoded speech frames are temporarily stored in a buffer memory 720 from which they are taken to a channel encoder in the transmitting block 704. In accordance with an advantageous embodiment of the invention, the speech encoding arrangement 721 comprises, before the speech encoder proper, a soft bandwidth switching unit of the type shown in FIG. 5 in order to implement soft bandwidth switching when the digital radio telephone of FIG. 7 acts as the uplink MS.

The conceivable advantage associated with the invention resides in the enhanced subjective quality of speech which is transmitted and/or received by the digital radio telephone of FIG. 7.

Figure 8:
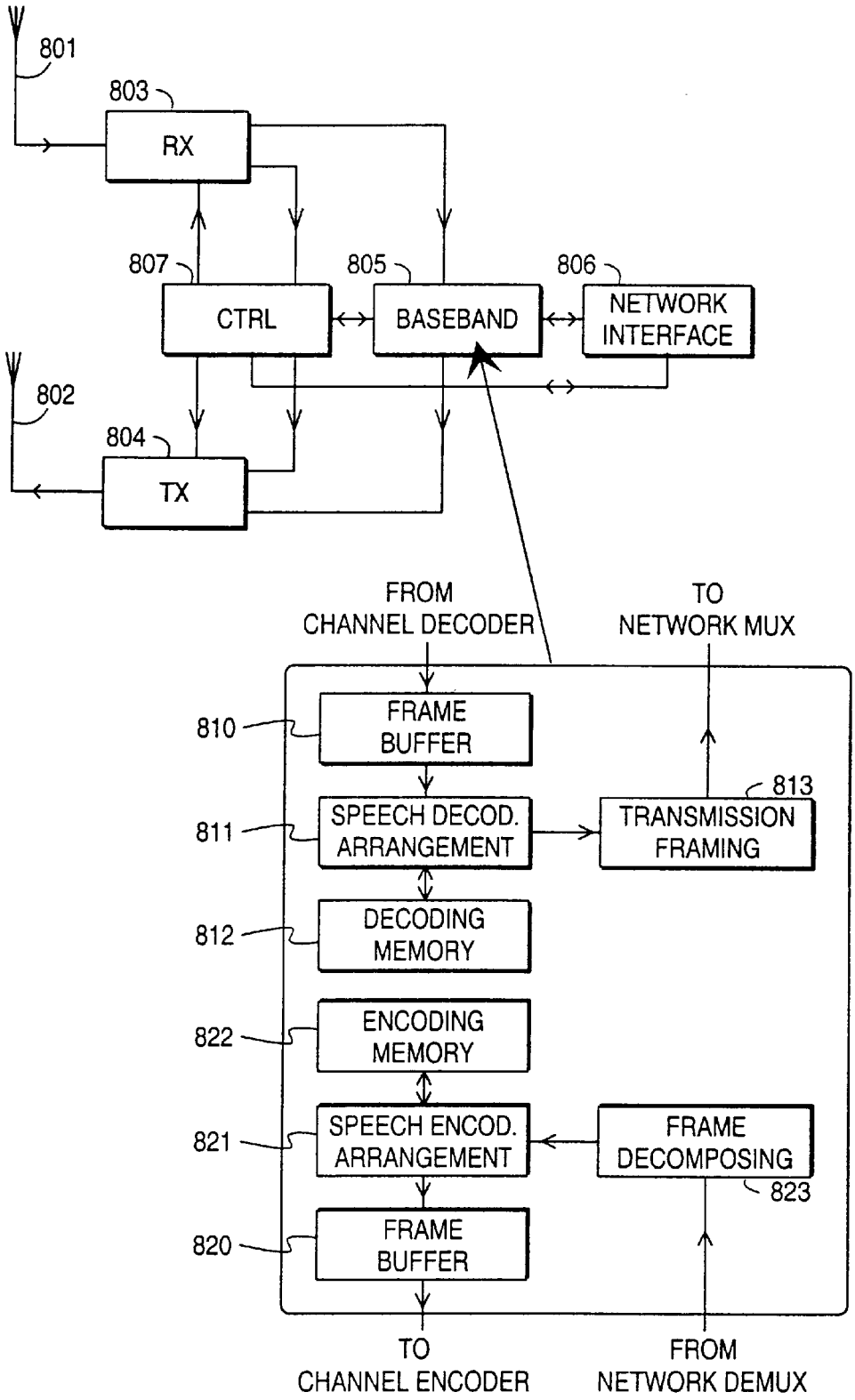

FIG. 8 illustrates a base station where a receiving antenna 801 is coupled to a receiving block 803 for receiving digitally coded speech over a radio interface and a transmitting antenna 802 is coupled to a transmitting block 804 for transmitting digitally coded speech over a radio interface. The receiving block 803 and transmitting block 804 are both coupled to a controller block 807 for conveying received control information and control information to be transmitted respectively. Additionally the receiving block 803 and transmitting block 804 are coupled to a baseband block 805 which comprises the baseband frequency functions for processing received speech and speech to be transmitted respectively. The baseband block 805 and the controller block 807 are coupled to a network interface 806 which typically comprises a network transmission multiplexer, a network reception demultiplexer and a number of transmitting, receiving, amplifying and filtering components (not specifically shown in FIG. 8).

A part of the baseband block 805 is shown in more detail in FIG. 8. The last part of the receiving block 803 is a channel decoder the output of which consists of channel decoded speech frames that need to be subjected to speech decoding before transmitting them to the network (taken that TFO is not in use). The speech frames obtained from the channel decoder are temporarily stored in a frame buffer 810 and read therefrom to the actual speech decoding arrangement 811. The latter implements a speech decoding algorithm read from a memory 812. In accordance with an advantageous embodiment of the invention, the speech decoding arrangement 811 comprises, after the speech decoder proper, a soft bandwidth switching unit of the type shown in FIG. 5 in order to implement soft bandwidth switching when the base station of FIG. 8 acts as the uplink TRAU.

The frame decomposing block 823 prepares speech signals received from the network for encoding. A speech encoding arrangement 821 performs the speech encoding according to an encoding algorithm read from a memory 822

(taken that TFO is not in use). The encoded speech frames are temporarily stored in a buffer memory 820 from which they are taken to a channel encoder in the transmitting block 804. In accordance with an advantageous embodiment of the invention, the speech encoding arrangement 821 comprises, before the speech encoder proper, a soft bandwidth switching unit of the type shown in FIG. 5 in order to implement soft bandwidth switching when the base station of FIG. 8 acts as the downlink TRAU.

The conceivable advantage associated with the invention resides in the enhanced subjective quality of speech which is processed by the base station of FIG. 8.

Various changes and modifications to the embodiments described above are possible without parting from the scope of the appended claims. For example, in a very simple embodiment of the invention the soft bandwidth switching block can be made completely without the adjustable gain unit 503 and adjustable filter 509 in the processing branch handling the narrow (lower) frequency band. This is possible if the amplitude proportions and relative spectral characteristics of the signals in the different processing branchs can be controlled to a reasonable accuracy with only the adjustable elements in the processing branch for the higher frequency band. The features recited in depending claims are freely combinable unless explicitly otherwise stated.

What is claimed is:

1. A speech encoding arrangement, comprising:

a speech signal input, a multiple mode speech encoder for encoding speech signals coupled to the speech signal input selectabily with a first encoding mode associated with a first bandwidth or a second encoding mode associated with a second bandwidth, and a soft bandwidth switching block with an input coupled to the speech signal input and an output coupled to the multiple mode speech encoder, said soft bandwidth switching block being arranged to gradually change the bandwidth of a speech signal coupled to the multiple mode speech encoder as a response to an instruction for changing speech signal bandwidth.

2. A speech encoding arrangement according to claim 1, wherein said soft bandwidth switching block comprises:

a first processing branch and a second processing branch, band combining means for combining the outputs of said first processing branch and said second processing branch into the output of said soft bandwidth switching block and at least within said second processing branch adjustable means for controllably changing the relative properties of signals which are processed in said first and second processing branches.

3. A speech encoding arrangement according to claim 2, wherein said adjustable means comprise an adjustable gain block.

4. A speech encoding arrangement according to claim 2, wherein said adjustable means comprise an adjustable filter.

5. A speech encoding arrangement according to claim 2, comprising band splitting means for directing a first frequency band of a speech signal coupled to the speech signal input into said first processing branch and a second frequency band of a speech signal coupled to the speech signal input into said second processing branch.

6. A speech encoding arrangement according to claim 2, comprising a noise generator coupled to said second processing branch through an adjustable filter for controllably producing an artificial signal into said second processing branch.

7. A speech encoding arrangement according to claim 6, comprising:

band splitting means for directing a first frequency band of a speech signal coupled to the speech signal input into said first processing branch and a second frequency band of a speech signal coupled to the speech signal input into said second processing branch, within said second processing branch adjustable means for changing the relative properties of said second frequency band of a speech signal and said artificial signal, and within said second processing branch combining means for combining said second frequency band of a speech signal and said artificial signal into the output of said second processing branch.

8. A speech encoding arrangement according to claim 2, comprising a bandwidth switching control unit which is coupled to said adjustable means for controlling the changes in the relative properties of signals which are processed in said first and second processing branches.

9. A digital radio telephone, comprising:

a speech encoding arrangement, a speech signal input to the speech encoding arrangement, within the speech encoding arrangement a multiple mode speech encoder for encoding speech signals coupled to the speech signal input selectabily with a first encoding mode associated with a first bandwidth or a second encoding mode associated with a second bandwidth, and a soft bandwidth switching block with an input coupled to the speech signal input and an output coupled to the multiple mode speech encoder, said soft bandwidth switching block being arranged to gradually change the bandwidth of a speech signal coupled to the multiple mode speech encoder as a response to an instruction for changing speech signal bandwidth.

10. A transcoder and rate adaptor unit of a cellular radio system, comprising:

a speech encoding arrangement, a speech signal input to the speech encoding arrangement, within the speech encoding arrangement a multiple mode speech encoder for encoding speech signals coupled to the speech signal input selectabily with a first encoding mode associated with a first bandwidth or a second encoding mode associated with a second bandwidth, and a soft bandwidth switching block with an input coupled to the speech signal input and an output coupled to the multiple mode speech encoder, said soft bandwidth switching block being arranged to gradually change the bandwidth of a speech signal coupled to the multiple mode speech encoder as a response to an instruction for changing speech signal bandwidth.

11. A speech decoding arrangement, comprising:

a speech signal input, a multiple mode speech decoder for decoding speech signals coupled to the speech signal input selectabily with a first decoding rate associated with a first bandwidth or a second decoding rate associated with a second bandwidth, and a soft bandwidth switching block with an input coupled to the multiple mode speech decoder and an output, said soft bandwidth switching block being arranged to gradually change the bandwidth of a speech signal received from the multiple mode speech decoder as a response to an instruction for changing speech signal bandwidth.

12. A speech decoding arrangement according to claim 11, wherein said soft bandwidth switching block comprises:

a first processing branch and a second processing branch, band combining means for combining the outputs of said first processing branch and said second processing branch into the output of said soft bandwidth switching block and at least within said second processing branch adjustable means for controllably changing the relative properties of signals which are processed in said first and second processing branches.

13. A speech decoding arrangement according to claim 12, wherein said adjustable means comprise an adjustable gain block.

14. A speech decoding arrangement according to claim 12, wherein said adjustable means comprise an adjustable filter.

15. A speech decoding arrangement according to claim 12, comprising band splitting means for directing a first frequency band of a speech signal received from the multiple mode speech decoder into said first processing branch and a second frequency band of a speech signal received from the multiple mode speech decoder into said second processing branch.

16. A speech decoding arrangement according to claim 12, comprising a noise generator coupled to said second processing branch through an adjustable filter for controllably producing an artificial signal into said second processing branch.

17. A speech decoding arrangement according to claim 16, comprising:

band splitting means for directing a first frequency band of a speech signal received from the multiple mode speech decoder into said first processing branch and a second frequency band of a speech signal received from the multiple mode speech decoder into said second processing branch, within said second processing branch adjustable means for changing the relative properties of said second frequency band of a speech signal and said artificial signal, and within said second processing branch combining means for combining said second frequency band of a speech signal and said artificial signal into the output of said second processing branch.

18. A speech decoding arrangement according to claim 12, comprising a bandwidth switching control unit which is coupled to said adjustable means for controlling the changes in the relative properties of signals which are processed in said first and second processing branches.

19. A digital radio telephone, comprising:

a speech decoding arrangement, a speech signal input to the speech decoding arrangement, within the speech decoding arrangement a multiple mode speech decoder for decoding speech signals coupled to the speech signal input selectabily with a first decoding rate associated with a first bandwidth or a second decoding rate associated with a second bandwidth, and a soft bandwidth switching block with an input coupled to the multiple mode speech decoder and an output, said soft bandwidth switching block being arranged to gradually change the bandwidth of a speech signal received from the multiple mode speech decoder as a response to an instruction for changing speech signal bandwidth.

20. A transcoder and rate adaptor unit of a cellular radio system, comprising:

a speech decoding arrangement, a speech signal input to the speech decoding arrangement, within the speech decoding arrangement a multiple mode speech decoder for decoding speech signals coupled to the speech signal input selectabily with a first decoding rate associated with a first bandwidth or a second decoding rate associated with a second bandwidth, and a soft bandwidth switching block with an input coupled to the multiple mode speech decoder and an output, said soft bandwidth switching block being arranged to gradually change the bandwidth of a speech signal received from the multiple mode speech decoder as a response to an instruction for changing speech signal bandwidth.

21. A method for changing the bandwidth of a speech signal in association with multiple mode encoding or decoding, comprising the steps of:

receiving an indication of a change in speech signal bandwidth and gradually changing the bandwidth of a speech signal processed in a multiple mode speech encoding or decoding arrangement as a response to said instruction for changing speech signal bandwidth.

22. A method according to claim 21, comprising the steps of:

receiving an early warning about an oncoming command for changing speech signal bandwidth, initiating a process of gradually changing the bandwidth of a speech signal processed in a multiple mode speech encoding or decoding arrangement as a response to said early warning and completing the process of gradually changing the bandwidth of a speech signal processed in a multiple mode speech encoding or decoding arrangement essentially just before executing a received command for changing speech signal bandwidth.

23. A method according to claim 21, comprising the steps of:

receiving a command for changing speech signal bandwidth, delaying the execution of said received command for changing speech signal bandwidth, conducting a process of gradually changing the bandwidth of a speech signal processed in a multiple mode speech encoding or decoding arrangement after receiving but before executing said command for changing speech signal bandwidth and executing said command for changing speech signal bandwidth by changing from one mode of said multiple mode speech encoding or decoding arrangement to another mode of said multiple mode speech encoding or decoding arrangement.

24. A method according to claim 21, comprising the steps of:

receiving a command for changing speech signal bandwidth and executing said command for changing speech signal bandwidth by changing from one mode of said multiple mode speech encoding or decoding arrangement to another mode of said multiple mode speech encoding or decoding arrangement, and conducting a process of gradually changing the bandwidth of a speech signal processed in a multiple mode speech encoding or decoding arrangement after executing said command for changing speech signal bandwidth.

25. A method according to claim 21, comprising the steps of:

receiving an early warning about an oncoming command for changing speech signal bandwidth, initiating a process of gradually changing the bandwidth of a speech signal processed in a multiple mode speech encoding or decoding arrangement as a response to said early warning, receiving a command for changing speech signal bandwidth and executing said command for changing speech signal bandwidth by changing from one mode of said multiple mode speech encoding or decoding arrangement to another mode of said multiple mode speech encoding or decoding arrangement, the execution of said command causing an interruption in the process of gradually changing the bandwidth of a speech signal, and completing the process of gradually changing the bandwidth of a speech signal processed in a multiple mode speech encoding or decoding arrangement after executing said command for changing speech signal bandwidth.

26. A method according to claim 21, wherein the step of gradually changing the bandwidth of a speech signal processed in a multiple mode speech encoding or decoding arrangement comprises the substeps of:

processing a first frequency band of a speech signal in a first processing branch and a second frequency band of a speech signal in a second processing branch and changing a gain factor in said second processing branch.

27. A method according to claim 26, wherein:

the substep of processing a first frequency band of a speech signal in a first processing branch and a second frequency band of a speech signal in a second processing branch comprises the substep of directing a frequency band extracted from an actual speech signal present at an speech signal input of the multiple mode speech encoding or decoding arrangement through a first adjustable gain unit and the substep of changing a gain factor in said second processing branch comprises the substep of adjusting the gain in said first adjustable gain unit.

28. A method according to claim 26, wherein:

the substep of processing a first frequency band of a speech signal in a first processing branch and a second frequency band of a speech signal in a second processing branch comprises the substeps of generating, within the multiple mode speech encoding or decoding arrangement, an artificial input signal and directing said artificial input signal through a second adjustable gain unit and the substep of changing a gain factor in said second processing branch comprises the substep of adjusting the gain in said second adjustable gain unit.

29. A method according to claim 26, wherein:

the substep of processing a first frequency band of a speech signal in a first processing branch and a second frequency band of a speech signal in a second processing branch comprises the substeps of:

directing a frequency band extracted from an actual speech signal present at an speech signal input of the multiple mode speech encoding or decoding arrangement through a first adjustable gain unit, generating, within the multiple mode speech encoding or decoding arrangement, an artificial input signal and directing said artificial input signal through a second adjustable gain unit, and combining the outputs of said first and second adjustable gain units; and the substep of changing a gain factor in said second processing branch comprises the substep of adjusting the gain in said first and second adjustable gain units.

30. A method according to claim 21, wherein the step of gradually changing the bandwidth of a speech signal processed in a multiple mode speech encoding or decoding arrangement comprises the substeps of:

processing a first frequency band of a speech signal in a first processing branch and a second frequency band of a speech signal in a second processing branch and changing the frequency response of an adjustable filter in said second processing branch.

31. A method according to claim 21, wherein the step of gradually changing the bandwidth of a speech signal processed in a multiple mode speech encoding or decoding arrangement comprises the substep of determining the rate of said gradual changing on the basis of the momentary contents of said speech signal.

32. A method according to claim 21, wherein the step of gradually changing the bandwidth of a speech signal processed in a multiple mode speech encoding or decoding arrangement comprises the substep of determining the rate of said gradual changing on the basis of the number of recently occurred changes in speech signal bandwidth.

33. A method according to claim 21, wherein the step of gradually changing the bandwidth of a speech signal processed in a multiple mode speech encoding or decoding arrangement comprises the substep of determining the rate of said gradual changing on the basis of the frequency of recently occurred changes in speech signal bandwidth.

* * * * *